United States Patent [19]

Pask

[11] Patent Number: 4,502,276

[45] Date of Patent: Mar. 5, 1985

[54] CASING STRUCTURE FOR A GAS TURBINE ENGINE

[75] Inventor: George Pask, Stanton-by-Bridge, England

[73] Assignee: Rolls-Royce Limited, London, England

[21] Appl. No.: 588,136

[22] Filed: Mar. 9, 1984

Related U.S. Application Data

[63] Continuation-in-part of Ser. No. 308,193, Sep. 18, 1981, abandoned.

[30] Foreign Application Priority Data

Oct. 21, 1980 [GB] United Kingdom ..... 8033849

[51] Int. Cl.[3] ..... F02C 7/20; F01D 25/24

[52] U.S. Cl. ..... 60/39.32; 415/138; 415/128

[58] Field of Search ..... 415/108, 128, 129, 132, 415/134, 135, 136, 138, 139, 170 R, 219 C, 219 R; 416/179, 190, 191; 60/39.31, 39.32

[56] References Cited

U.S. PATENT DOCUMENTS 2,933,893 4/1960 Blyth et al. ..... 60/39.32
4,264,274 4/1981 Benedict ..... 415/219 R
4,365,470 12/1982 Matthews et al. ..... 60/39.32
4,428,189 1/1984 Greenberg et al. ..... 60/39.31
4,439,982 4/1984 Weiler et al. ..... 60/39.32

*Primary Examiner*—Louis J. Casaregola
*Assistant Examiner*—Timothy S. Thorpe
*Attorney, Agent, or Firm*—Cushman, Darby & Cushman

[57] ABSTRACT

A casing structure for a gas turbine engine comprises an outer load-bearing casing within which is supported an inner casing which forms the static structure of a compressor. Bearing panels carried from the outer casing carry the rotor of the compressor and its associated turbine. In order to mitigate the undesirable consequences of the bending under load of the outer casing, the inner casing is mounted at a forward section by forward mounting means which maintain it concentric with the rotor axis and at a rearward section by rearward mounting means which maintain it parallel with a section of the outer casing which retains its parallelism with the rotor axis even when the casing bends. The forward mounting illustrated is a dogged engagement while the rearward mounting utilizes a parallel series of links as a parallel motion linkage.

7 Claims, 4 Drawing Figures

CASING STRUCTURE FOR A GAS TURBINE ENGINE

Figure 1:
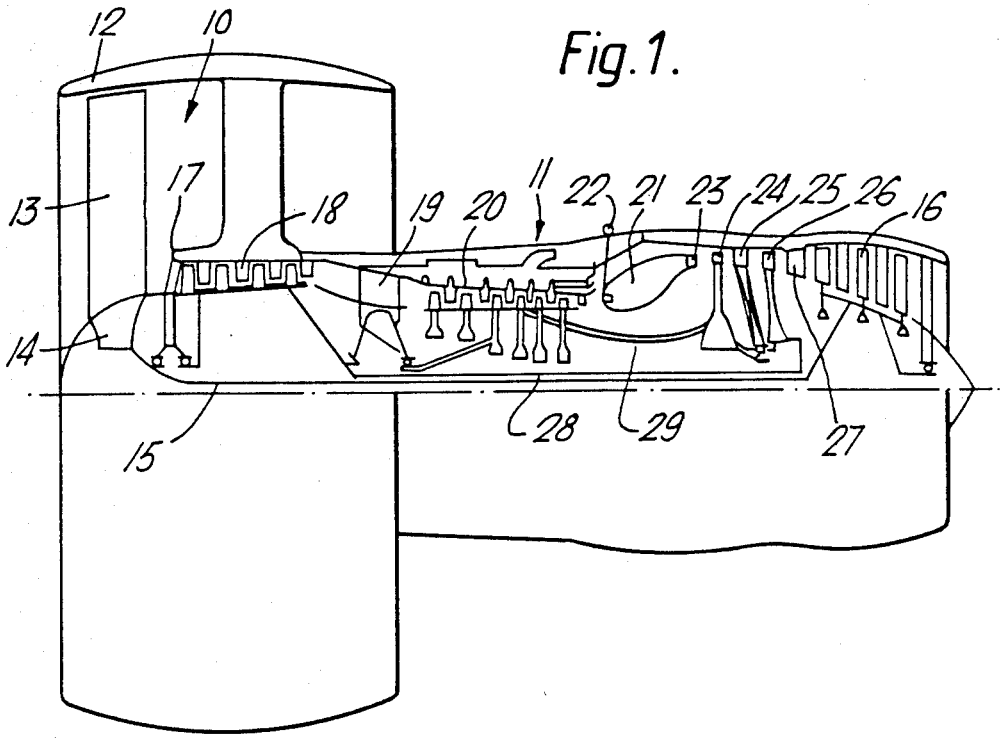

This application is a continuation in part of U.S. application Ser. No. 308,193, filed Sept. 18, 1981, now abandoned.

This invention relates to a casing structure for a gas turbine engine.

In the search for improved specific fuel consumption designers have become increasingly concerned with the elimination of those features of gas turbine engines which cause losses. One such feature is the tip clearance between the rotating aerofoil blades of the engine and its associated shroud or casing. For some time attempts have been made to reduce this clearance in the turbine of the engine, but with increased overall engine pressure ratios it is becoming important to control the tip clearance of at least the highest pressure compressor rotor blades.

Control of this clearance is made difficult because it is conventional to support the shroud or compressor casing with which the rotor blades cooperate from the main load-bearing casing of the engine. This casing is subject to the loads, for instance thrust loads, which distort the casing. One such distortion which has been difficult to cope with comprises bending of the complete casing so that its axis becomes curved rather than straight. Because the rotor blades are carried from a shaft system which is not subject to substantial bending loads and is in any case stiffened by centrifugal effects, the rotor does not bend to follow the distortion of the casing. The rotor is normally carried in axially spaced apart bearing panels from the casing, hence the combination of the distorted casing with the undistorted rotor supported within it will change the rotor/shroud clearances.

In order to allow for these changes it is conventionally necessary to set the static clearances artificially high, with consequent aerodynamic penalties and loss of efficiency.

The present invention provides a casing construction which takes advantage of the fact that a main engine casing when distorted in the manner described above will have a section axis midway between the bearing panels which although radially displaced will remain parallel with the rotor axis. Using this fact, an inner casing is provided which is mounted from the outer casing in such a way as to enable it to stay more closely concentric with the rotor should the outer casing bend in the manner described above.

According to the present invention a casing structure for a gas turbine engine comprises a load-bearing outer casing, forward and rearward bearing panels, coaxial forward and rearward rotor bearings carried by said forward and rearward bearing panels respectively from said outer casing, an inner casing mounted within said outer casing, forward support means which maintain a forward portion of said inner casing substantially concentric with said forward rotor bearing, and rearward support means which support a rearward portion of said inner casing from said outer casing, the rearward support means comprising a parallel motion linkage which interconnects the rearward portion of the inner casing and a section of the outer casing located between the bearing panels whose axis remains parallel with the axes of said bearings when the casing is otherwise distorted in bending due to applied loads, the parallel motion linkage comprising a plurality of parallel axially extending links which move parallel to each other to allow a degree of radial displacement between said inner casing and said section and to maintain the axis of said inner casing parallel to said section.

Usually said section of the outer casing will comprise a mid-section of the casing, and it will normally be convenient to mount the forward extremity of the inner casing from the forward support means.

The plurality of parallel, axially extending links interconnect said inner casing or a projection therefrom and said section of the outer casing or a projection therefrom. The links may be rigidly fixed at each end, so that the relative radial displacement is permitted by bending of the links, or alternatively they may be flexibly mounted at either or both ends so as to permit said displacement.

The forward support means preferably involves supporting the forward extremity of the inner casing from the forward bearing panel by way of a joint structure which will maintain the desired concentricity while permitting some relative angular movement in planes containing the bearing axis.

Figure 3:
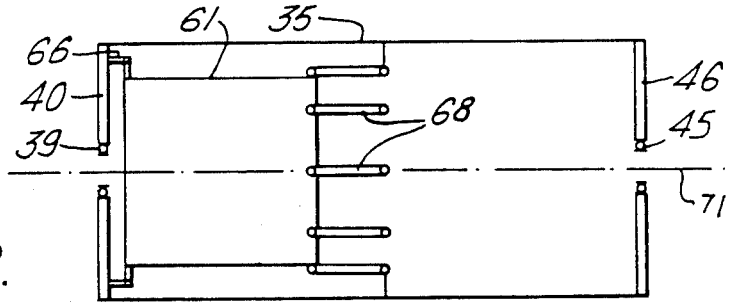
Figure 4:
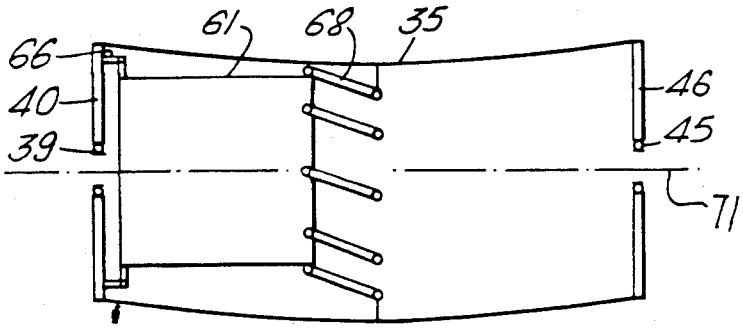
Figure 2:
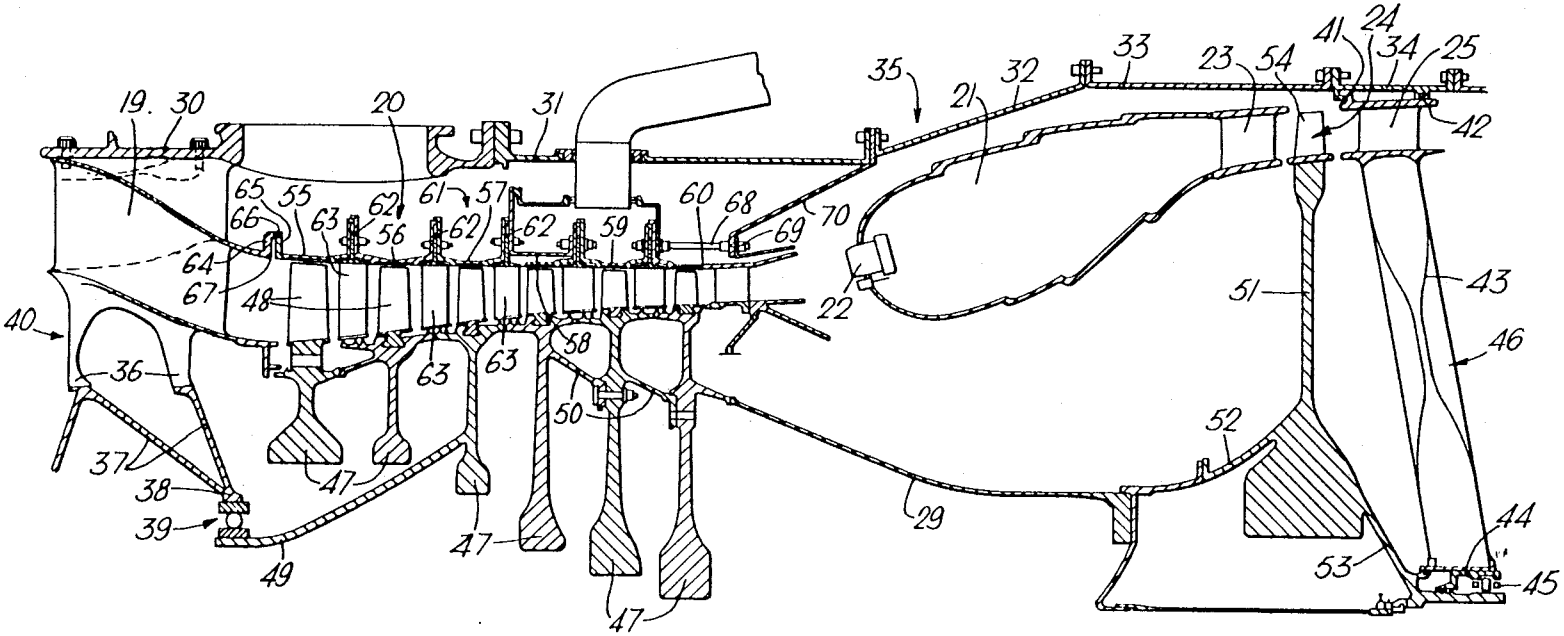

The invention will now be particularly described, merely by way of example, with reference to the accompanying drawings in which:

FIG. 1 is a partly broken-away view of a gas turbine engine having a casing structure in accordance with the present invention, FIG. 2 is an enlarged section through part of the engine of FIG. 1 showing the structure of the invention in greater detail, and FIGS. 3 and 4 are sketches illustrating, in an exaggerated fashion, the operation of the structure of the present invention.

In FIG. 1 there is shown a ducted fan type of gas turbine engine comprising the usual combination of a fan 10 driven from a core engine 11. The fan 10 will be seen to consist of a fan cowl 12 within which rotate a stage of fan blades 13. The fan blades 13 are mounted on a disc 14 which is driven by a fan shaft 15 from a low pressure turbine 16.

The fan blades 13 operate to compress and accelerate air which then flows in two streams, one of which passes between the core engine 11 and the fan cowl 12 to provide propulsive thrust and the other of which enters the core engine 11 via an intake 17. The air entering the intake 17 is compressed by an intermediate pressure axial flow compressor 18, passes through the struts 19 which form part of a bearing panel to be further described later, and is further compressed in a high pressure axial flow compressor 20 which is also described in detail below.

Compressed air delivered by the high pressure compressor 20 enters a combustion chamber 21 where it is mixed with fuel atomized in the injectors of a fuel supply arrangement 22. The fuel/air mixture burns in the combustion chamber 21 and the resulting hot gases pass through high pressure nozzle guide vanes 23 to drive the high pressure turbine 24, then through intermediate pressure nozzle guide vanes 25 to drive the intermediate pressure turbine 26 and then through low pressure nozzle guide vanes 27 to drive the multistage low pressure turbine 16. The intermediate pressure vanes 25 form part of a second bearing panel, again described more fully below.

As mentioned above, the low-pressure turbine 16 drives the fan disc 14 and blades 13 by way of the low pressure shaft 15 and in a similar manner the intermediate pressure turbine 26 drives the intermediate pressure compressor 18 by way of the intermediate shaft 28 and the high pressure turbine 24 drives the high pressure compressor 20 by way of the high pressure shaft 29.

As described so far the engine is relatively conventional, however, FIG. 2 shows in detail the novel casing construction for the high-pressure compressor 20 and associated structure in accordance with the invention. It will be seen that the struts 19 referred to above are bolted to a ring section 30 which is the foremost member of a series of rings 30, 31, 32, 33 and 34 which are bolted together at their flanged extremities to form a casing of generally cylindrical form which will be given the generic reference numeral 35. This composite outer casing 35 is part of the main load-bearing static structure of the core engine 11 and as described below operates to carry inter alia the bearings which in turn carry the rotating system comprising the high pressure compressor 20, shaft 29 and turbine 24. The casing 35 does in fact form part of a longer casing of the engine, but only the portion consisting of the rings 30 to 34 is of interest in the present instance.

As mentioned above the casing ring 30 carries the struts 19 and these in turn support from feet 36 a pair of frusto-conical webs 37 which meet at their inner extremity to form a ring 38 which supports the outer race of a ball bearing 39. The struts 19, feet 36, webs 37 and ring 38 together form a forward bearing panel to which will be allotted the reference numeral 40.

The other end of the casing 35, consisting of the ring 34, carries the plurality of intermediate pressure nozzle guide vanes 25 through a hooked engagement at 41 and a dogged engagement at 42. At their inner extremities the vanes 25 are attached to a diaphragm structure 43 which extends inwardly to a ring 44 which supports the outer race of a roller bearing 45 coaxial with the ball bearing 39. The vanes 25, diaphragm structure 43 and ring 44 together form a rearward bearing panel to which will be allotted the reference numeral 46.

The bearings 39 and 45 carried by the panels 40 and 46 provide the support for a rotating system consisting of the rotor of the high pressure compressor 20, the shaft 29 and the rotor of the high pressure turbine 24. As can be seen the rotor of the compressor 20 comprises a series of discs 47 each of which carries a stage of rotor blades 48 from its periphery. Each disc 47 is connected to its neighbors to form a compressor drum, and the third disc in the series is provided with a stub shaft 49 which engages within the bearing 39 to provide forward support for the rotor. The rearward three discs are interconnected by frusto-conical flanges at 50, these flanges forming in effect an extension of the shaft 29 which is connected to the rearmost disc to drive and support the compressor rotor.

At its rearward extremity the shaft 29 is connected to a turbine rotor disc 51 by way of a stub shaft 52 extending from the disc. On its opposite face the disc 51 is provided with a further frusto-conical stub shaft 53 which is carried in the bearing 45 to provide rearward support for the rotor. As is conventional, the disc 51 carries a stage of turbine rotor blades 54.

It will therefore be seen that, as mentioned above, the high pressure rotor system is carried from the casing 35 via the bearing panels 40 and 46.

Turning to the static structure, it will be appreciated that the compressor 20 requires static structure which defines the outer boundary of the airflow through the compressor and which provides support for the stator blades of the compressor. In the present instance this function is carried out by the series of flanged rings 55, 56, 57, 58, 59 and 60 which are bolted together to form an inner casing to which the reference numeral 61 will be allotted. The abutting flanges of the casing rings serve to locate radial mounting extensions 62 from stages of stators 63; this construction is further elaborated and claimed in the co-pending published British application No. 2111129.

At its forward extend the inner casing 61 is supported from the assembly of struts 19 by forward support means comprising the engagement between a radial flange 64 carried from the struts 19 and a radial flange 65 which forms the forward flange of the flanged ring 55. To this end the flanges engage with one another through a dogged connection at 66, in which dogs extending radially from the flange 65 engage with dogs extending axially from the flange 64. The flanges are resiliently sealed together. In the embodiment illustrated this is effected by a Belleville washer 67 interposed between them, however, it will be appreciated that if the use of these washers proves unsatisfactory other more conventional alternatives are available. It will be understood that this engagement, while holding the casing 61 concentric with the bearing 39, will allow the casing to tilt to a small degree. Because the engagement at 66 is arranged to lie substantially in the same plane as the bearing 39, any such tilting displacement will not sensibly affect the concentricity between this forward extremity of the casing 61 and the bearing 39.

In order to provide rearward support means for the rearward part of the casing 61, the flanged abutment between the rearward two rings 59 and 60 has an arrangement of parallel links 68, which are equi-spaced circumferentially and which extend between and attach the flanges of rings 59 and 60 to a supporting flange 69 formed on the forward end of a frusto-conical web 70. The web 70 is in turn bolted to the casing 35 between the flanges of the rings 31 and 32, at a position which in this case is approximately mid-way along the casing 35 between the bearing panels 40 and 46. As described below the positions of this attachment is determined by the behavior of the casing under bending loads and may not always be mid-way along the casing. The parallel links 68 are in this case rigidly fixed to the casing flanges and support ring; in fact the ends of the parallel links are screwed so that the forward ends can act as bolts to hold together the flanges of the rings 59 and 60 while the rearward ends are bolted to the flange 69.

In the embodiment illustrated the parallel links 68 are rigidly supported at their ends but are of such a number and of such dimensions that they are able to bend to some extend to allow the rearward part of the inner casing 61 to be displaced radially with respect to the outer casing 35. It would of course be possible to achieve a similar effect by the use of rigid links and a degree of flexibility in the connections between the links and the casing structures.

In order to enable the operation of the structure described above to be more easily understood, FIGS. 3 and 4 show the basic features of the construction in a much simplified manner. FIG. 3 shows the structure as it would be when none of the casings was distorted. It will be seen that the rotor axis 71 is straight and defined by the bearings 39 and 45 which are supported via the panels 40 and 46 from the outer, load bearing casing 35. The casing 35, in its undistorted condition, is coaxial with the rotor and shares the axis 71. The inner casing 61 is supported at forward support means 66 concentric with the bearing 39 and hence the rotor axis 71, and at a rearward position it is supported by rearward support means comprising the parallel links 68 which extend in the undistorted condition from the casing 35 parallel to the axis 71. These parallel links form a parallel motion linkage which keeps this rearward portion of the casing 61 parallel with the mid-section of the casing 35, hence the casing 61 is also concentric with the rotor. This is the normal static condition of the engine structure, and it is usual to set up the tip clearances between the rotor blades 48 and their associated shroud or casing structures (55, 56, 57, 58, 59, 60) at this condition.

Because the casing 35 carries loads in operation it will inevitably distort, and FIG. 4 shows, in a much exaggerated manner, the effect of one form of such distortion. It will be seen that the casing, instead of being cylindrical as in the unloaded condition, has bent between the strong bearing panels 40 and 46 so that its axis becomes a curve. If the inner casing 61 were simply mounted from the casing 35 in the conventional manner, this casing would be displaced particularly at its rearward end with respect to the straight line axis defined by the bearings 39 and 45. Since the rotor carried by these bearings is not subject to the forces deforming the casing 35, the rotor axis 71 is unchanged and the clearances between the rotor blade tips and the casing 61 would be altered.

In the structure of the present invention, however, the mounting at 66 of the forward part of the casing 61 ensures that even if the panel 40 tilts, this part of the casing 61 remains concentric with the axis 71. The parallel motion linkage formed by the parallel links 68 will deflect but will simultaneously ensure that the axis of the casing 61 is maintained parallel with that section of the outer casing 35 which lies approximately midway between the panels 40 and 46 and to which the links are eventually connected. Although this section of the casing 35 is the one which is most displaced radially, its section axis is still parallel with the axis 71 in this region.

The parallel motion linkage deflects to ensure that the axis of the inner casing 61 is maintained parallel with that section of the outer casing 35 whose section axis remains parallel to the rotor axis 71, i.e. the mid-section in this case. This is achieved because the parallel links 68 are able to flex, bend or move with radial or tangential components, or with a combination of both, while remaining parallel with each other, and so they allow relative displacement in any radial direction between the rearward part of the inner casing 61 and the outer casing 35. Thus it can be seen that the parallel links 68, which are initially arranged to extend axially parallel to the rotor axis 71 and each other, will move radially, tangentially or with a combination of radial and tangential components, depending upon their circumfernetial position and the direction of the distortion in the outer casing 35, while remaining parallel to each other. The parallel links 68 form a parallel motion linkage which allows the outer casing 35 and inner casing 61 to move in any radial direction with respect to each other. It is necessary that the parallel links remain parallel in order for the rearward mounting to function correctly and that they are capable of movement in radial, tangential or combinations of radial and tangential directions.

As disclosed previously the parallel links 68 may be rigid and have flexible connections between the links and the casing structures. In this arrangement the links would remain straight and parallel to each other. If the parallel links 68 were flexible, with rigid connections between the links and the casing structures, the links would bend and all would take up identical shapes, so any similar points in the links would be parallel.

The effects of the mounting 66 and the parallel links 68 are thus to ensure that the inner casing is held concentric with the axis 71 at its forward end, and parallel with this axis at its rearward end. It will be appreciated that these constraints ensure that the casing is held coaxial with the axis 71 and hence with the rotor, and that the undesirable variations in the blade tip clearances are thus avoided.

It will be noted that it is essential that the linkage made up of the links 68 is supported from a part of the casing 35 which maintains its axis parallel with the axis 71 even when the casing is distorted. Normally this part of the casing will be approximately mid-way between the panels 40 and 46, but if the casing 35 is of considerable irregularity of thickness or other dimension this part may well be displaced away from the mid-portion. In this case the links 68 would have to be connected to this diffierent part of the casing, if necessary through interposed structure.

It should also be understood that the parallel motion linkage formed by the parallel links 68, whether rigid with flexible mounts or flexible in themselves, is a very simple and convenient way of ensuring the necessary parallelism between the casing 61 and relevant part of the casing 35. However, other linkages or support systems could be used to obtain the same effect.

Similarly, the mounting at 66 using a dogged engagement between the casing and the panel structure could be replaced by other constructions such as a flexible diaphragm or by a mounting using the distortion of thin sections of one of the supporting members to allow relative tilting but to maintain the desired concentricity.

I claim:

1. A casing structure for a gas turbine engine comprising:

a load bearing outer casing;

a forward bearing panel supported from a forward end of said outer casing, said forward bearing panel carrying a forward rotor bearing;

a rearward bearing panel supported from said outer casing, said rearward bearing panel carrying a rearward rotor bearing, said forward rotor bearing and said rearward rotor bearing being coaxial;

an inner casing mounted within said outer casing;

forward support means for maintaining a forward portion of said inner casing substantially concentric with said forward rotor bearing;

and rearward support means supporting a rearward portion of said inner casing from said outer casing, said rearward support means comprising a parallel motion linkage interconnecting the rearward portion of said inner casing and a section of said outer casing located intermediate said forward bearing panel and said rearward bearing panel at a location of said outer casing having a movable axis which remains parallel with an axis of said forward bearing and said rearward bearing when said outer casing is otherwise distorted in bending due to applied loads, said parallel motion linkage including a plurality of parallel axially extending links movable parallel to each other in both radial and tangential directions to allow a degree of radial displacement between said inner casing and said section of said outer casing to maintain an axis of said inner casing parallel to said movable axis of said section of said outer casing.

2. A casing structure as claimed in claim 1 and in which said links are rigidly attached at their ends and are so dimensioned as to be capable of bending to permit said radial displacement.

3. A casing structure as claimed in claim 1 and in which said links are resiliently attached at their ends so that said radial displacement is permitted by the resilience of said attachments.

4. A casing structure as claimed in claim 1 and in which said forward support means allows said inner casing to tilt about said forward bearing.

5. A casing structure as claimed in claim 1 and in which said forward support means supports said inner casing from said forward bearing panel.

6. A casing structure as claimed in claim 5 and in which said forward support means comprises radially extending dogs carried from the inner casing which engage with axially extending dogs carried from the forward bearing panel.

7. A casing structure as claimed in claim 1 and in which said section of the outer casing comprises a mid-section of the casing.

* * * * *